United States Patent [19]

Kabelsky

[11] Patent Number: 5,062,361

[45] Date of Patent: Nov. 5, 1991

[54] CREDIT CARD IMPRINTER WITH ONE-PIECE SLIDER

[75] Inventor: Mikhail Kabelsky, New York, N.Y.

[73] Assignee: Bartizan Corporation, Yonkers, N.Y.

[21] Appl. No.: 557,406

[22] Filed: Jul. 23, 1990

[51] Int. Cl.[5] ..... B41F 3/04

[52] U.S. Cl. ..... 101/269; 101/45

[58] Field of Search ..... 101/45, 56, 269, 270, 101/271, 272, 273, 274

[56] References Cited

U.S. PATENT DOCUMENTS

| | | | |
|---|---|---|---|
| 3,272,120 | 9/1966 | Johnson | 101/269 |
| 3,763,777 | 10/1973 | Brown | 101/269 |
| 4,281,596 | 8/1981 | Bowen | 101/269 |
| 4,324,181 | 4/1982 | Maul, Sr. | 101/269 |
| 4,457,228 | 7/1984 | Wittek | 101/45 |

*Primary Examiner*—Edgar S. Burr
*Assistant Examiner*—Ren Yan
*Attorney, Agent, or Firm*—Wyatt, Gerber, Burke & Badie

[57] ABSTRACT

A credit card imprinter has a flat imprinter base on which a merchant plate, a credit card and a form set are positioned. A hand operated carriage is pulled back-and-forth over the form set and imprints the merchant plate, in one direction, and the credit card, in the opposite direction, on the form set. The carriage contains two independent platen rollers each rotatably mounted on a separate axle. The axles and their rollers are urged upwards by springs and are automatically shifted from an upward idle position to a downward print position by a unitary one-piece plastic slider. The slider has four outwardly extending arm portions which act on the axles to shift their heights.

4 Claims, 4 Drawing Sheets

CREDIT CARD IMPRINTER WITH ONE-PIECE SLIDER

BACKGROUND OF THE INVENTION

1. Field Of The Invention

The present invention relates to credit card imprinters and particularly to such imprinters using dual roller platens.

2. Description Of The Related Art

Credit card imprinters in widespread use are generally those in which separate cards or plates, having embossed characters, are used to imprint a joined pile of forms, i.e., a "form set". For example, a form set for recording information relating to a sales transaction may be imprinted with vendor information, from a metal merchant plate, and customer information, from a plastic credit card carried by the customer.

These printers generally have comprised a flat, rectangular printing base on which the credit card, the merchant plate, and possibly auxiliary printers for charge and date are mounted. A platen carriage, containing one roller platen on an axle or two roller platens on separate axles, is pulled over the printing base and impresses a form set with embossed characters from the merchant plate and credit card and from the date and charge printers.

U.S. Pat. No. 4,457,228, assigned to Bartizan Corporation, incorporated by reference herein, relates to a credit card imprinter in which a platen carriage has dual roller platens set on separate parallel roller platen axles. The axle heights are individually adjustable to desired printing levels allowing for adjustment to the different printing elements and thus permitting the use of printing surfaces requiring less accuracy.

In that printing apparatus a platen carriage contains a credit roller platen and a merchant plate roller platen, each mounted on a separate roller axle. Each roller platen axle is perpendicular to and presses upwardly on two horizontal arm members, each having one lower horizontal ledge and one higher horizontal ledge. When a roller platen axle abuts against the lower ledge the platen is held downwardly in position to imprint characters and when the platen axle abuts against the higher ledge, the platen is held idle so that it cannot imprint characters. A lever mechanism switches an axle from the lower ledge to the higher ledge when a shift lever, pivotly mounted on the platen carriage, hits against either of two stops located at each end of the platen carriages, travel across the imprinting base. That dual platen roller imprinting mechanism is comparatively easy to disassemble for service and part replacement and allows each separate height adjustments for both credit card and merchant plate platens.

However, the internal mechanism of the carriage is relatively complex and requires seven separate parts (usually six metal, and one plastic) to perform the function of shifting the heights of the axles.

SUMMARY OF THE INVENTION

In accordance with the present invention there is provided a credit card imprinter in which a carriage is pulled in a reciprocal motion across a flat imprinting base on which are positioned the merchant plate, a credit-card and a form set. Two axles are mounted within the carriage and each carries a rotatable platen roller.

The height of the axles relative to the base is automatically shifted by a slider, which is a unitary one-piece plastic member. The slider has a central portion and four outwardly extending arm portions. Each of the arm portions, on its bottom surface, has as portions of a continuous surface; a horizontal upper ledge, a slanted can face and a horizontal lower ledge.

OBJECTIVES AND FEATURES OF THE INVENTION

It is an objective of the present invention to provide a credit card imprinter having a platen carriage and dual platen rollers, in which the slider mechanism to shift the heights of the roller axles is relatively simple, so that it is relatively low in cost, and yet is reliable in operation.

It is a further objective of the present invention to provide such a credit card imprinter in which the slider mechanism may be readily replaced, if needed, in a relatively simple operation.

It is a feature of the present invention to provide a credit card imprinter including a base member having a flat top face and means to locate at least one embossed card on the top face. A carriage is slidingly connected to the base member and may be pulled by hand over the top face in a reciprocal motion. First and second axles are rotatably mounted within the carriage with a first platen roller mounted on the first axle and a second platen roller mounted on the second axle. Each of the axles, and their rollers, has a raised idle position and a lowered imprinting position. A slider means is used to shift the axles alternatively from their idle to their imprinting positions. The slider means comprises a one-piece unitary member having a central portion with an imaginary median line therethrough, a front face and a rear face, and four arm portions extending outwardly from the central portion with two arms extending outwardly on each side of the median line. Each of the arm portions has a bottom surface which abuts an axle and positions the height position of the axle. Each bottom surface has an upper horizontal ledge portion, an inclined cam portion and a lower horizontal ledge portion. In operation, the first and second base cam means contact the slider front face and rear face, respectively, to shift the slider.

BRIEF DESCRIPTION OF THE DRAWINGS

Other objectives and features of the present invention will be apparent from the following detailed description, to be considered with the drawings. In the drawings.

DETAILED DESCRIPTION OF THE INVENTION

Figure 2:
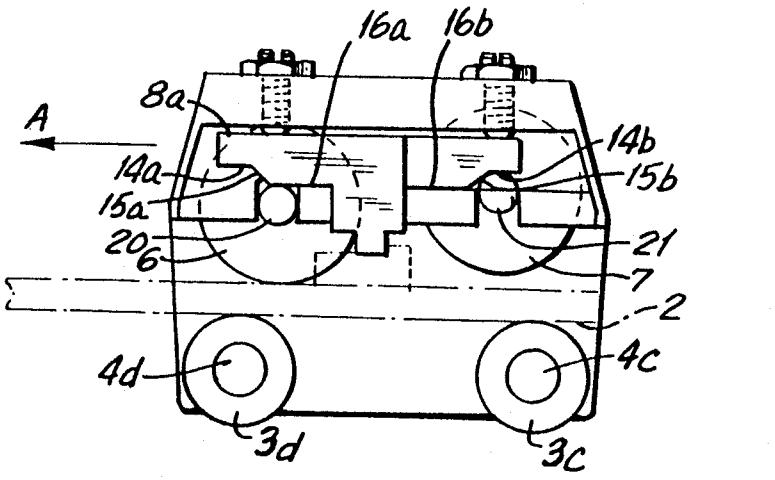
FIG. 2 is a cross-sectional view along section A-A showing one position of the slider.

The present invention is of an improved credit card imprinter which uses fewer parts, thereby lowering its cost and improving its reliability.

In general, a credit card imprinter is used to imprint the raised embossed alphanumeric characters on a credit card and a merchant plate onto a multi-copy paper form set. The credit card is usually plastic and the merchant plate is usually either metal or plastic. The credit card is placed, with its raised characters face upwards, on the top face of the flat imprinting base 2 of the credit card imprinter and within a set of guide fingers 2a. In addition, a merchant plate having embossed characters is also located on the top face of base 2. The form set is placed on top of the credit card and the merchant plate. The user will then place his fingers on the platen carriage 1 and pull the carriage back and forth in a reciprocal movement over the form set and the embossed card and plate. When the platen carriage 1 is pulled over the form set in one direction a first rotatable roller 6 (print platen roller) is lowered and imprints one card and when the carriage is pulled back, in the opposite direction, an automatic shifting means shifts the rollers 6 and 7 so that the second roller 7 (print platen roller) is lowered and imprints the other card (see FIGS. 2 and 3).

This general type of credit card imprinter is dealt with in U.S. Pat. No. 4,457,228, assigned to Bartizan Corp., and incorporated by reference herein. A set of four wheels 3a–3d are used to guide the carriage and limit its upward movement so that the rollers (print platens) may apply a selected pressure on the form set. The wheels 3a–3d are mounted on, and freely rotate respectively upon, the round shafts 4a–4d which inwardly protrude from the inner face 5 of the wall 30 of the carriage 1. The wheels 3a–3d ride on the bottom face of the base 2, preferably within a groove (track). The wheels 26a, 26b rotatably mounted on shafts 27a, 27b, respectively, limit the upward movement of the carriage 1.

As shown in FIGS. 1–4 the slider 10 is formed as a onepiece integral member, e.g., of an injection molded plastic resin, for example Delrin (TM of DuPont).

The slider 10 includes a center portion 11. For strength the center portion 11 is formed in the shape of two truncated triangles 12a, 12b.

Four outwardly extending arm portions 13a–13d extend from the center portion 11. Each of the arm portions 13a–13d, on their bottom surfaces, has as portions of a continuous surface: an upper ledge 14a–14d, an inclined cam face 15a–15d, and a lower ledge 16a–16d. The upper portions 8a–8d of the arm portions 13a–13d are slidable within the grooves 9a–9d formed in the underside of the roof of the carriage 1.

The arm portions 13a and 13b are offset and similarly the arm portions 13c and 13d are offset. Consequently, as seen in FIG. 1, the outer side 17d of arm portion 13d is aligned (in the same plane) as the inner side 18c of arm portion 13c, and the outer side 17a is aligned (in the same plane) as the side 17b.

Figure 7A:
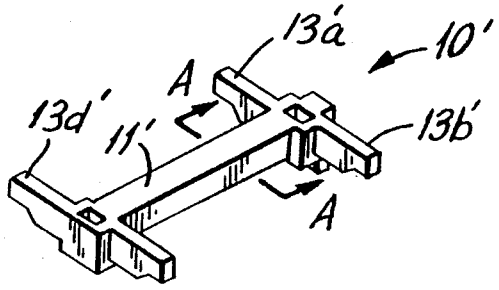
FIG. 7A is a perspective view of an alternative slider.
Figure 7B:
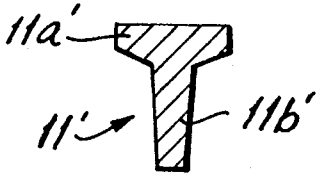
FIG. 7B is a cross-sectional view taken along line A-A of FIG. 7A.

As shown in FIG. 7A, an alternative slider 10', like slider 10, is a one-piece integral member, for example injection molded Delrin (TM of DuPont). The center portion 11' is formed as a beam. The four extending arm portions 13'a–13d' extend from the center portion 11' and are formed in the same manner, and perform the same functions, as the arms 13a–13d of slider 10. As shown in FIG. 7B the center portion beam 11', in cross-section, has a wider top portion 11a' and a centered narrower bottom portion 11b'.

Figure 1:
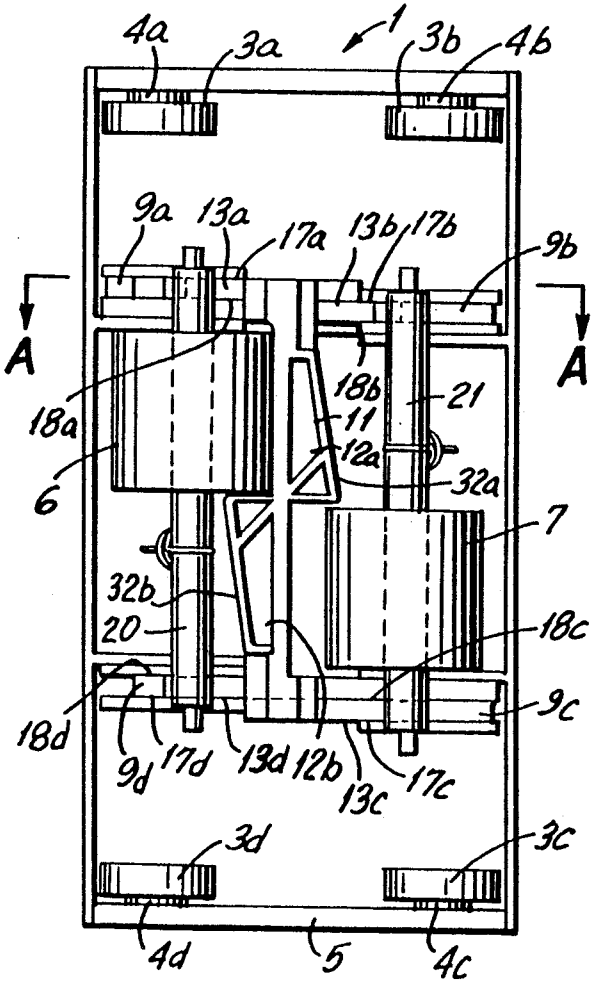
FIG. 1 is a bottom view of the carriage.
Figure 4:
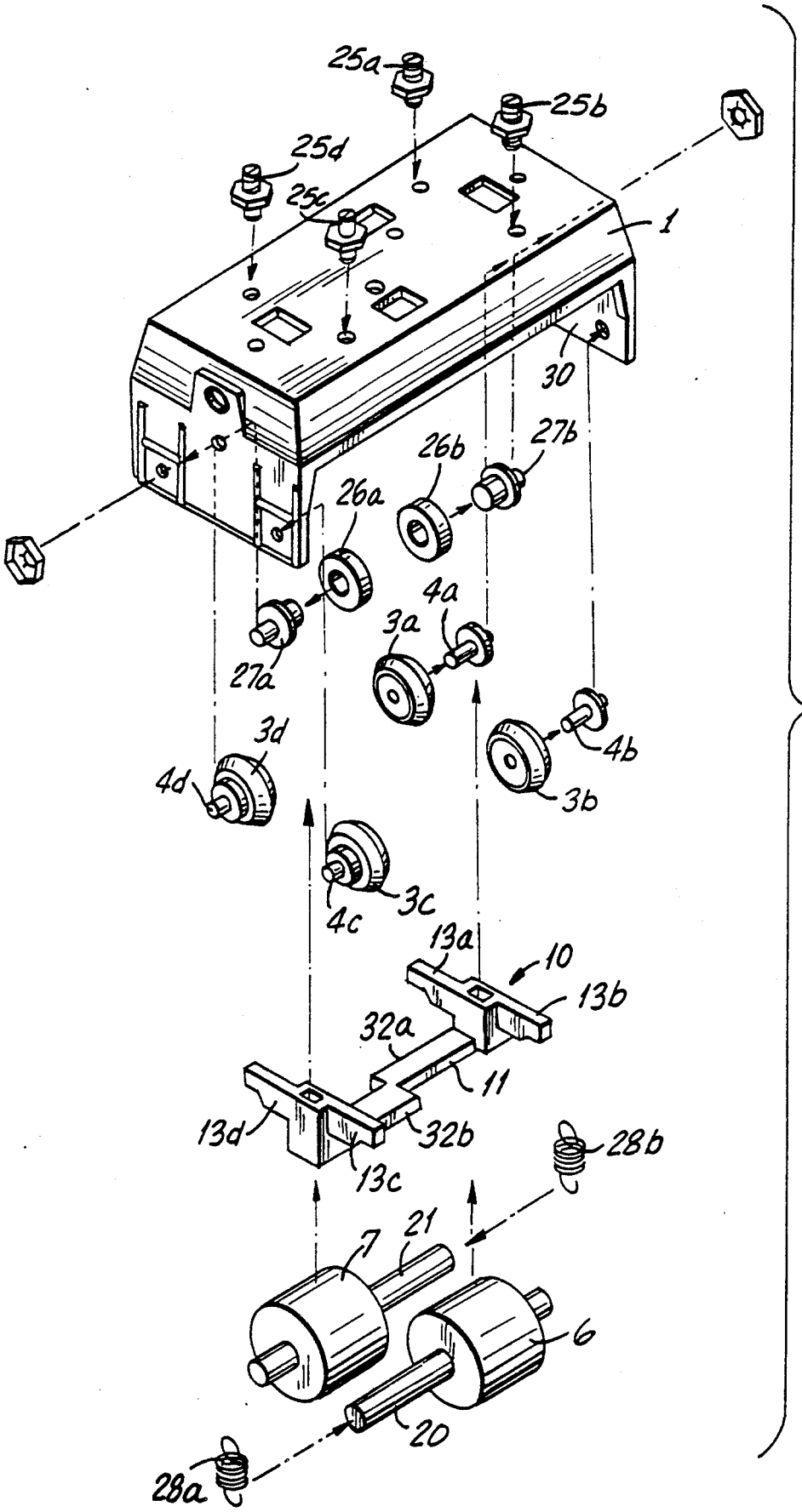
FIG. 4 is an exploded perspective view of the carriage.
Figure 5:
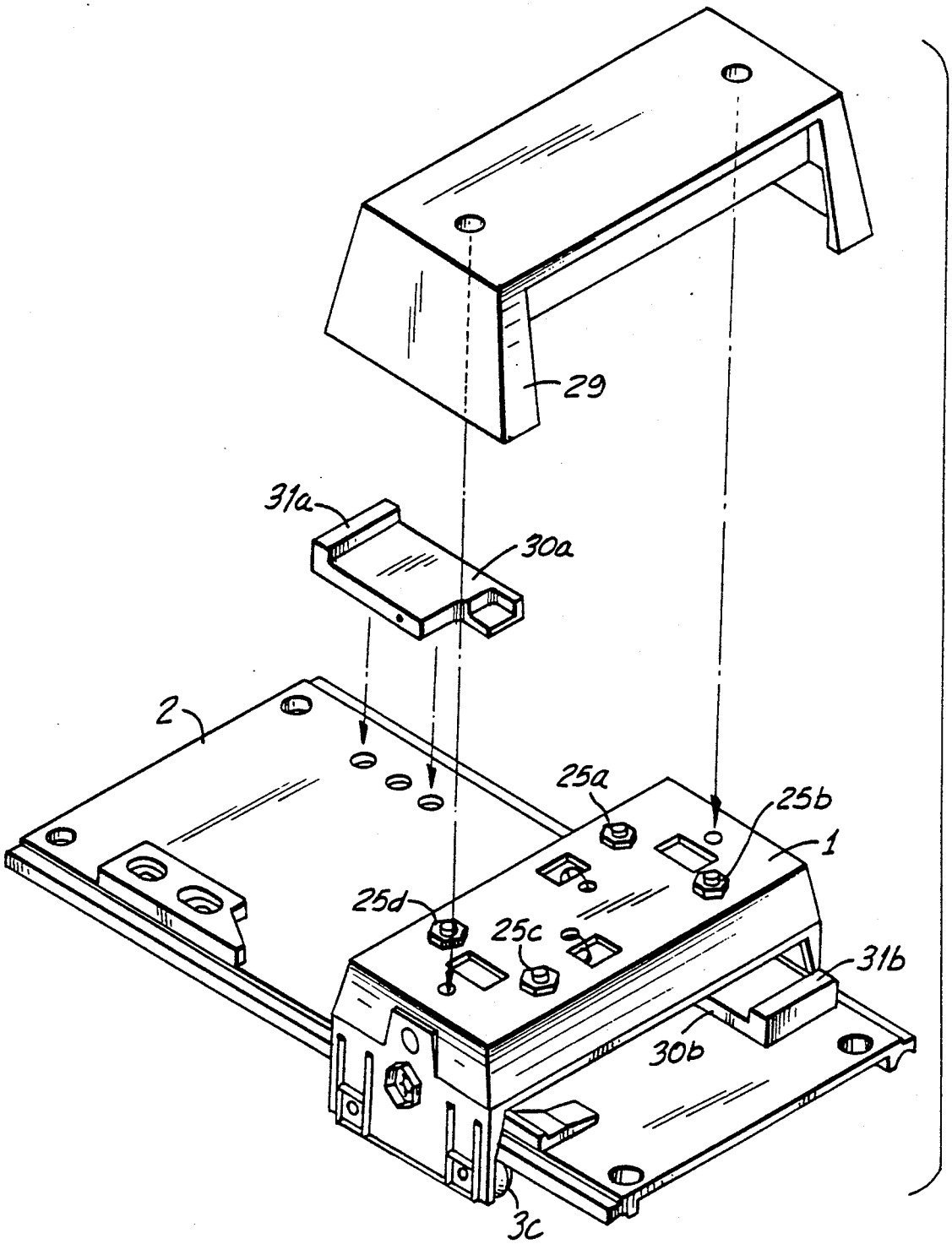
FIG. 5 is an exploded perspective view of the base, carriage and carriage cover.

In the position shown in FIGS. 1 and 2, with the roller 6 lowered (in its print position) and the roller 7 raised (in its idle position) the lower ledges 16a and 16d of arm portions 13aand 13d ride on top of the round metal shaft 20. The upper ledges 14b and 14c ride on top of the round metal axle (shaft) 21. The round cylindrical plastic platen roller 6 is fixed to axle 20 and a second round cylindrical plastic roller 7 is fixed to axle 21. The platen rollers 6 and 7 rotate as the carriage 1 is pulled over the base 2 so that the rollers 6 and 7, in sequence, roll over the form set and apply pressure on the form set, and the underlying card and plate, to imprint the raised characters of the card and plate onto the form set.

Figure 3:
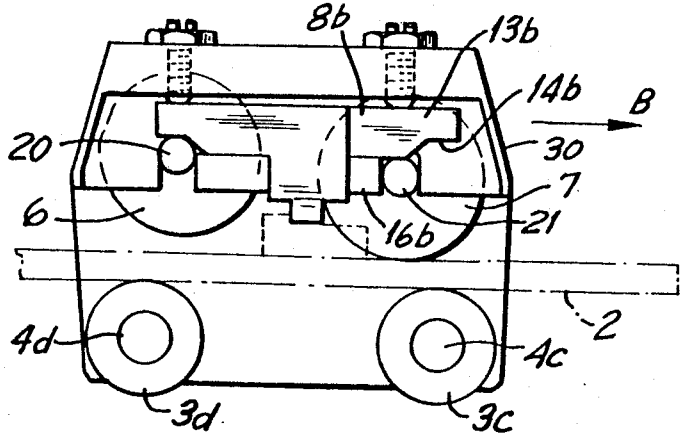
FIG. 3 is similar to FIG. 2, but showing the alternative position of the slider.

In the position shown in FIG. 3 the roller 7 is lowered and the roller 6 is raised. The lower ledges 16b and 16c ride on the top of the axle 21. The upper ledges 14a and 14d ride on top of the axle 20.

The amount of pressure exerted by the rollers 6 and 7 is adjustable by turning one or more of the adjustment screws 25a–25d. For example, the screw 25a is turned and lowered its rounded end 25a applies pressure and lowers the top face 26a of the arm portion 13a. The lower ledge 16a is lowered and lowers the axle 20, thereby increasing the pressure applied by platen roller 6.

The springs 28a, 28b are connected to the top of the carriage 1 and to the axles 20, 21 and urge the shafts upwards against the arms 13a–13d.

The carriage 1 is covered by a removable plastic carriage cover 29. The cover is removed to adjust the screws 25a–25d or the repair the internal mechanism of the carriage 1.

The slider 10 is shifted by the cam blocks 30a, 30b having cam flange portions 31a, 31b, respectively ("base cam means"). The flange portions (cam means) at the end of the carriage travel, act against the respective front and rear faces 32a, 32b of the slider 10 and shift the slider forward (or backwards). That shift of the slider 10 causes its arms 13a–13d to shift the axle 20 downward and the axle 21 upward (in one direction shown by arrow A; FIG. 2) and to shift the axle 21 upward and the axle 20 downward (in the opposite direction, shown by arrow B; FIG. 3).

In operation, the user will place the customer's credit card on the base 2. The merchants card is in place as it generally is fastened to the base. He will then place a form set over the two cards and pull the carriage 1 over the form set. When he pulls in one direction (direction of arrow A of FIG. 2) the platen roller 6 is lowered and imprints one card or plate. When the rear face 32b of the slider 10 hits the flange portion 31a, the contact shifts the slider (to the right in FIGS. 2 and 3), with the slider being guided within the grooves 9a–9d. The user will then pull the carriage in the opposite direction (direction of arrow B of FIG. 3) causing the platen roller 7, which has been lowered by the shifting of the slider 10, to imprint the other card or plate. The slider is again shifted back to its original position when its front face 32a contacts the flange portion 31b at the opposite end of the base 2.

Figure 6:
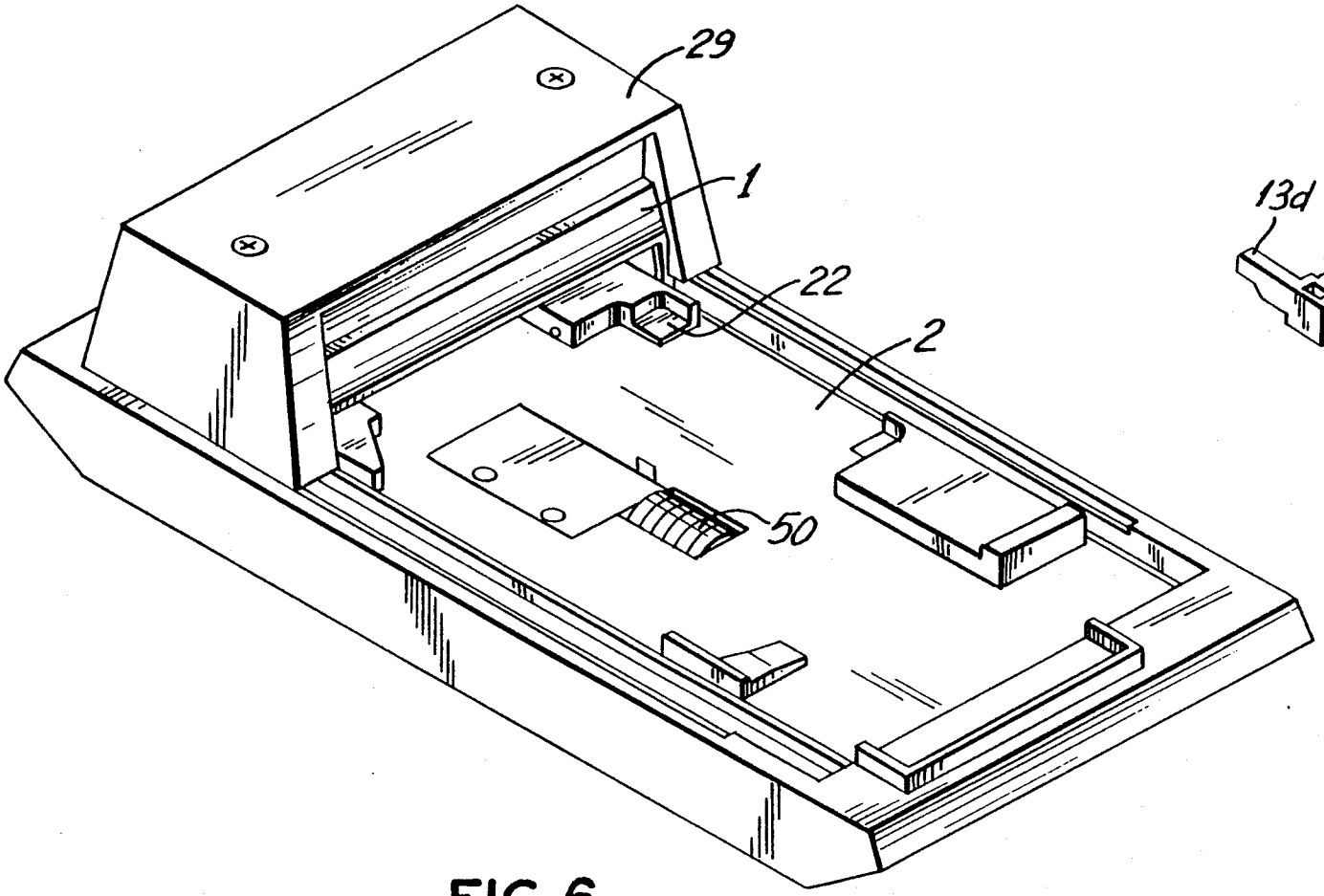
FIG. 6 is a perspective view of the credit card imprinter of the present invention.

The base 2 can also have rotatably mounted date information 50 (FIG. 6): six rollers having numerals 0–9 embossed thereon; two rollers (two digits) for day; two rollers (two digits) for month; and two rollers (two digits) for year. Date information 50 is set accordingly by the user, prior to operation. Date information 50 is imprinted with the alphanumeric characters of the merchant plate.

I claim:

1. A credit card imprinter including a base member having a flat top face, means to locate at least one embossed card on said top face, a carriage slidingly connected to said base member and adapted to be hand-pulled over said top face in a reciprocal motion, first and second cam means positioned on said base member, first and second axles within said carriage, a first platen roller mounted on said first axle and a second platen roller mounted on said second axle; each of said axles and the rollers carried thereon having a raised idle position and a lowered imprinting position; and a slider means to shift said axles alternatively from said idle to said imprinting position; said slider means comprising a one-piece unitary member having a central portion with an imaginary median line therethrough, a front face and a rear face, four arm portions extending outwardly from the central portion with two arms extending outwardly on each side of said median line; each of said arm portions having a bottom surface which abuts an axle and positions the height position of the axle, each of said bottom surfaces having an upper horizontal ledge portion, an inclined cam portion and a lower horizontal ledge portion; wherein said first and second base cam means contact said slider front face and rear face, respectively, to shift said slider.

2. A credit card imprinter as in claim 1 wherein said central portion is formed as two truncated, right-angle triangles shaped portions.

3. A credit card imprinter as in claim 1 wherein said slider means is a one-piece injected plastic resin member.

4. A credit card imprinter as in claim 1 and including first and second springs each connected to said carriage and to said first and second axles, respectively, to urge each of said axles upward against a pair of said arm portions.

* * * * *